US008602295B1

(12) United States Patent
Sanders et al.

(10) Patent No.: US 8,602,295 B1
(45) Date of Patent: Dec. 10, 2013

(54) SELECTABLE RECOGNITION OF CURRENCY DEPOSITED INTO A CASH HANDLING DEVICE

(75) Inventors: William Thomas Sanders, Denver, NC (US); Daniel Christopher Bohen, Charlotte, NC (US); Amy Baker Folk, Charlotte, NC (US)

(73) Assignee: Bank of American Corporation, Charlotte, NC (US)

( * ) Notice: Subject to any disclaimer, the term of this patent is extended or adjusted under 35 U.S.C. 154(b) by 367 days.

(21) Appl. No.: 12/183,888

(22) Filed: Jul. 31, 2008

(51) Int. Cl.
*G07F 19/00* (2006.01)

(52) U.S. Cl.
USPC ..... 235/379; 235/380

(58) Field of Classification Search
USPC ..... 235/375, 379, 380, 383; 705/1.1, 39, 43
See application file for complete search history.

(56) References Cited

U.S. PATENT DOCUMENTS 5,553,320 A * 9/1996 Matsuura et al. ..... 235/379
5,905,810 A 5/1999 Jones et al.
5,915,518 A * 6/1999 Hopwood et al. ..... 194/207
6,078,683 A * 6/2000 Denison et al. ..... 382/135
6,128,402 A 10/2000 Jones et al.
7,185,749 B2 3/2007 Armanini et al.
7,362,891 B2 4/2008 Jones et al.
2004/0011622 A1* 1/2004 Omori et al. ..... 194/230
2005/0108165 A1* 5/2005 Jones et al. ..... 705/43
2009/0107800 A1* 4/2009 Nishida et al. ..... 194/302

* cited by examiner

*Primary Examiner* — Daniel St.Cyr

(74) *Attorney, Agent, or Firm* — Banner & Witcoff, Ltd.; Michael A. Springs

(57) ABSTRACT

Methods and devices provide flexible demarcation points in order to selectably recognize currency deposited in a cash handling device. A denomination threshold may be set. A deposit may be requested. Currency may be deposited and scanned in order to determine its denomination. The currency may be routed to a stacker corresponding to the currency's denomination. If the denomination of the currency is less than or equal to the denomination threshold, then the deposit may be credited to an account. Otherwise, crediting of the account may be delayed until the currency can be verified as, for example, not invalid reproductions of currency. Information about the deposit may be communicated to a bank.

18 Claims, 6 Drawing Sheets

SELECTABLE RECOGNITION OF CURRENCY DEPOSITED INTO A CASH HANDLING DEVICE

BACKGROUND

Cash handling devices (e.g., cash recyclers) typically contain one or more stackers or rollers that hold currency. For example, one stacker may hold "one dollar" bills; another may hold "five dollar" bills; still another may hold "twenty dollar" bills; yet another may hold "fifty dollar" bills; and a further may hold "one hundred dollar" bills. Currency deposited into the cash handling device may be scanned and then routed to the appropriate stacker.

Currently, banks had one of two options. The banks could credit automatically and promptly all deposits to the account of the retailer or other entity where the cash handling device was located. This option may expose a bank to potential improper activity. For example, invalid reproductions of currency could be deposited into the currency handling device. The funds would then be credited to the retailer's account. The retailer may then access those funds and, for example, withdraw authentic currency at another location or write checks against the funds in the account before the bank was alerted to the fact that invalid reproductions of currency had been inserted into the cash handling device.

Alternatively, banks could refuse to credit deposits to the retailer's account until the bank was able to retrieve the currency from the cash handling device, transport it to the bank's facility, verify the that currency is not an invalid reproduction of currency, and then credit the currency to the retailer's account. This may be inconvenient for retailers, because there may then be a delay between the date of deposit and a later date when the funds are available for use in the retailer's account.

Thus, there is no currently available system that provides a dynamic balance between the interests of convenience for customers and security for banks who provide the cash handling devices.

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

In accordance with various embodiments of the present invention, methods and devices can provide flexible demarcation points in a cash handling device. For example, methods and devices can provide selectable and reconfigurable recognition and access to funds and/or compartments in a cash handling device.

In one embodiment, currency may be deposited into a cash handling device. The cash handling device may determine whether the denomination of the currency is less than a threshold. If the denomination of the currency is less than (or less than or equal to) a threshold, the deposited currency may be credited to an account.

In another embodiment, crediting of an account may be delayed if the denomination of the currency is greater than (or greater than or equal to) the threshold.

In still another embodiment, the currency may be routed to a stacker corresponding to the denomination of the currency.

In a further embodiment, the currency may be scanned in order to determine its denomination or to identify invalid reproductions of currency.

In still a further embodiment, a bank or other remote facility may be notified after a deposit has been made into a cash handling device. The notification may indicate that an account should be credited. The notification may indicate that a deposit should be verified.

In yet another embodiment, the threshold may be dynamic and may be set in order to provide a flexible demarcation between what is automatically credited to an account and what will be credited after verification.

In a further embodiment, the threshold may be set remotely or locally.

In yet a further embodiment, a denomination threshold may be set. A deposit may be requested. Currency may be deposited into a cash handling device. The currency may be scanned in order to determine its denomination. The currency may be routed to a stacker corresponding to the denomination. A determination may be made as to whether the denomination of the currency is less than or equal to the denomination threshold. The deposited currency may be credited to an account if the denomination of the currency is less than or equal to the denomination threshold. Crediting of the account may be delayed if the denomination of the currency is greater than the denomination threshold. Information about the deposited currency may be communicated to a bank.

In another embodiment, the denomination threshold may be selected from the group consisting of: $5, $10, $20, $50, $100, €5, €10, €20, €50, and €100. In other embodiments, any other denomination threshold may be used.

In yet another embodiment, the apparatus may be a cash handling device.

In still another embodiment, the cash handling device may be a cash recycler.

In another embodiment, an input means and display may include a touch sensitive screen.

In yet another embodiment, the input means may include a touch-sensitive screen.

In still another embodiment, the display may include a touch sensitive screen.

In other embodiments, the input means may include a keypad or keyboard.

Additional features and advantages of the invention will be apparent upon reviewing the following detailed description.

BRIEF DESCRIPTION OF THE DRAWINGS

The present disclosure is illustrated by way of example and not limited in the accompanying figures in which like reference numerals indicate similar elements.

DETAILED DESCRIPTION

In accordance with various aspects of the disclosure, systems and methods are illustrated for providing selectable recognition of currency deposited into a cash handling device.

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
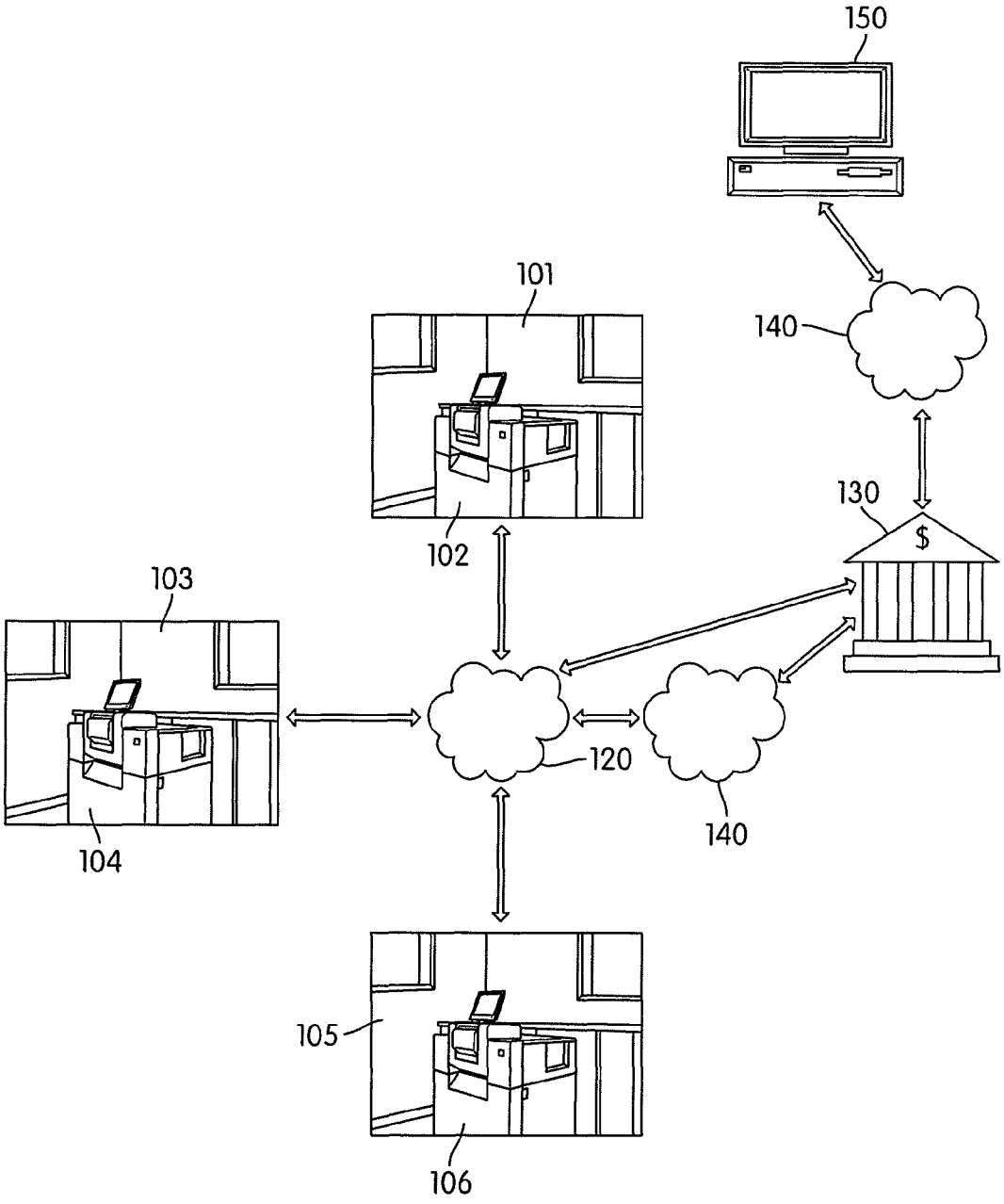
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 such as the STAR network before being connected to bank 130. According to one or more arrangements, bank 130 may utilize an infrastructure which includes a server 150 having components such as a memory, a processor, a display, and a communication interface.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, stackers 217 and cartridges 215 are configured to store currency. Currency may be inserted through input slot 209 and withdrawn through withdrawal slot 211. Stackers 217 may be used to store and organize currency based on denomination. For example, all $5 bills may be stored in stacker 2 (i.e., stacker 217B) while all $20 bills may be stored in stacker 3 (i.e., stacker 217C). Cartridges 215A and 215B, on the other hand, may be used to store overflow currency and/or currency for transport. Thus, if stackers 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and stackers 217 may further be removable for easier access or transport.

Scanning unit 207 may be configured to scan each bill or currency that is inserted into recycler 200. Scanning unit 207 may be configured to detect defects, invalid reproductions of currency, denomination, type of currency (e.g., which country the currency originates from) and the like. Scanning unit 207 may further be configured to refuse money (either through input slot 209 or withdrawal slot 211) if it cannot be properly recognized or if the currency is deemed to be invalid reproductions of currency. Scanning unit 207 may send such data to processor 201 which may, in turn, save the data in memory 203.

Further, recycler 200 may include one or more mechanical or electromechanical systems (not shown) for automatically transferring currency between stackers 217, cartridges 215, input slot 209 and withdrawal slot 211 in recycler 200. For example, currency may automatically be withdrawn from stackers 217 and directed into cartridge 215A for storage using a series of motorized rollers. In another example, currency stored in cartridge 215A may be withdrawn and organized and stored into stackers 217 according to denomination. Using such systems to facilitate the automated movement of currency between storage components and other portions of recycler 200 may provide efficiency and security by alleviating some of the need to manually handle currency stored within recycler 200.

Figure 2:
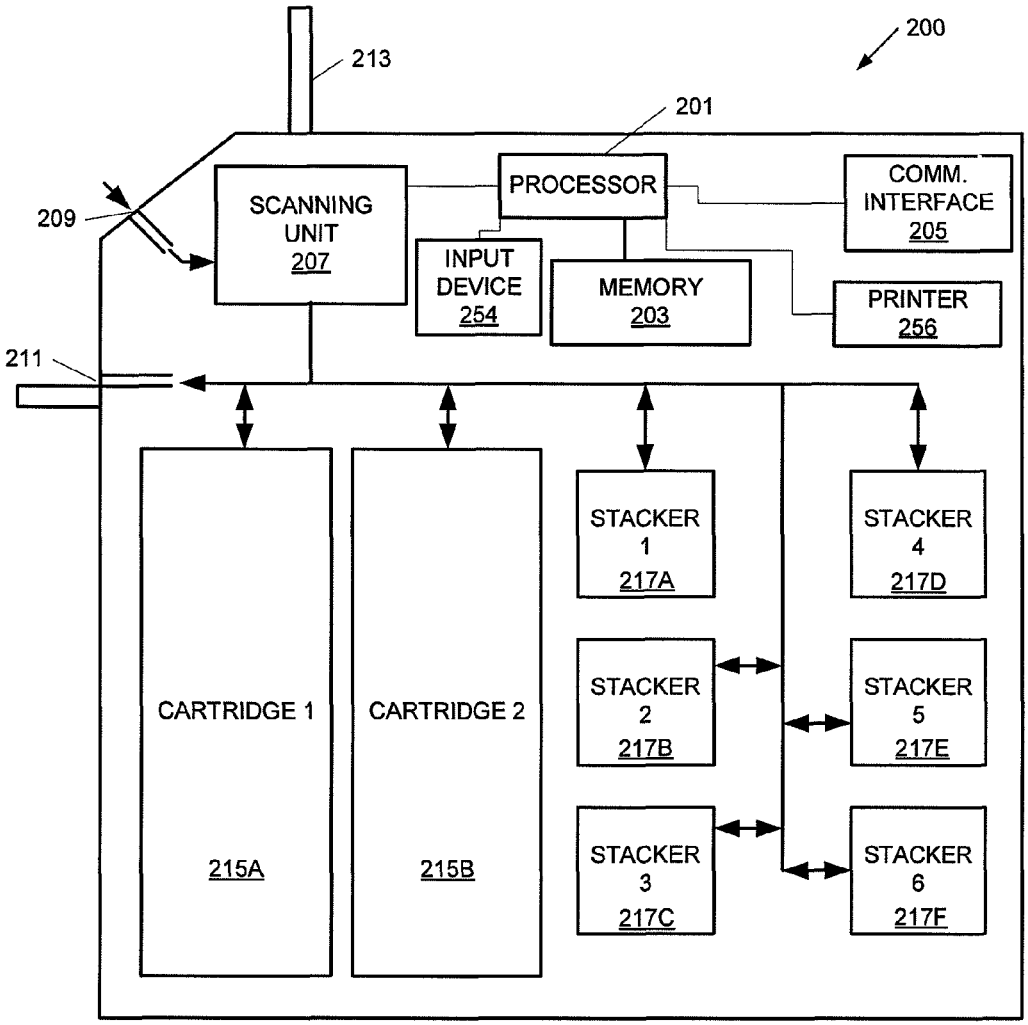
FIG. 2 illustrates a simplified diagram of a cash handling device in accordance with an aspect of the invention.
Figure 3:
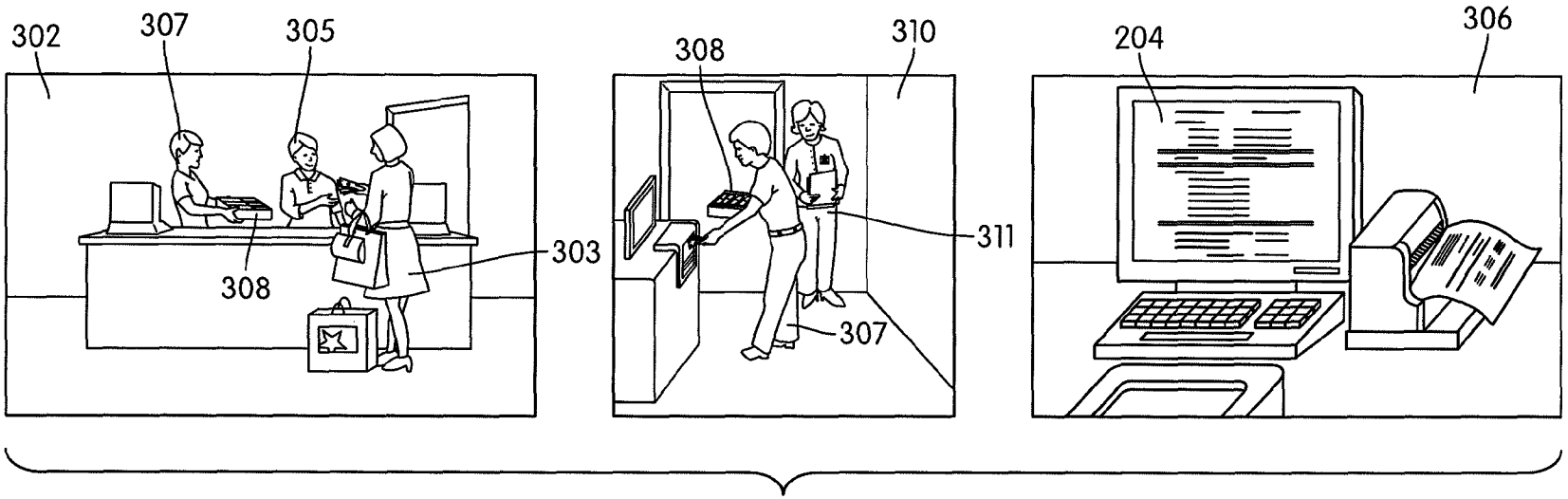
FIG. 3 illustrates various features of a cash handling device that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
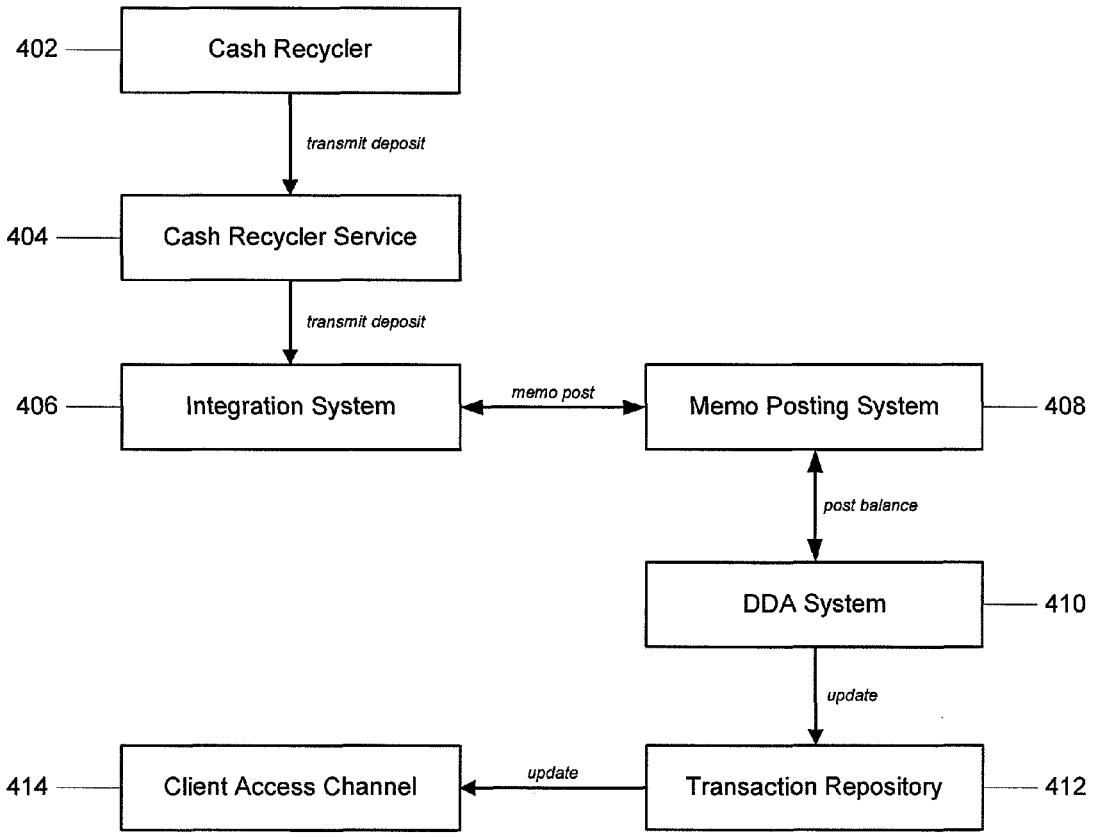
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
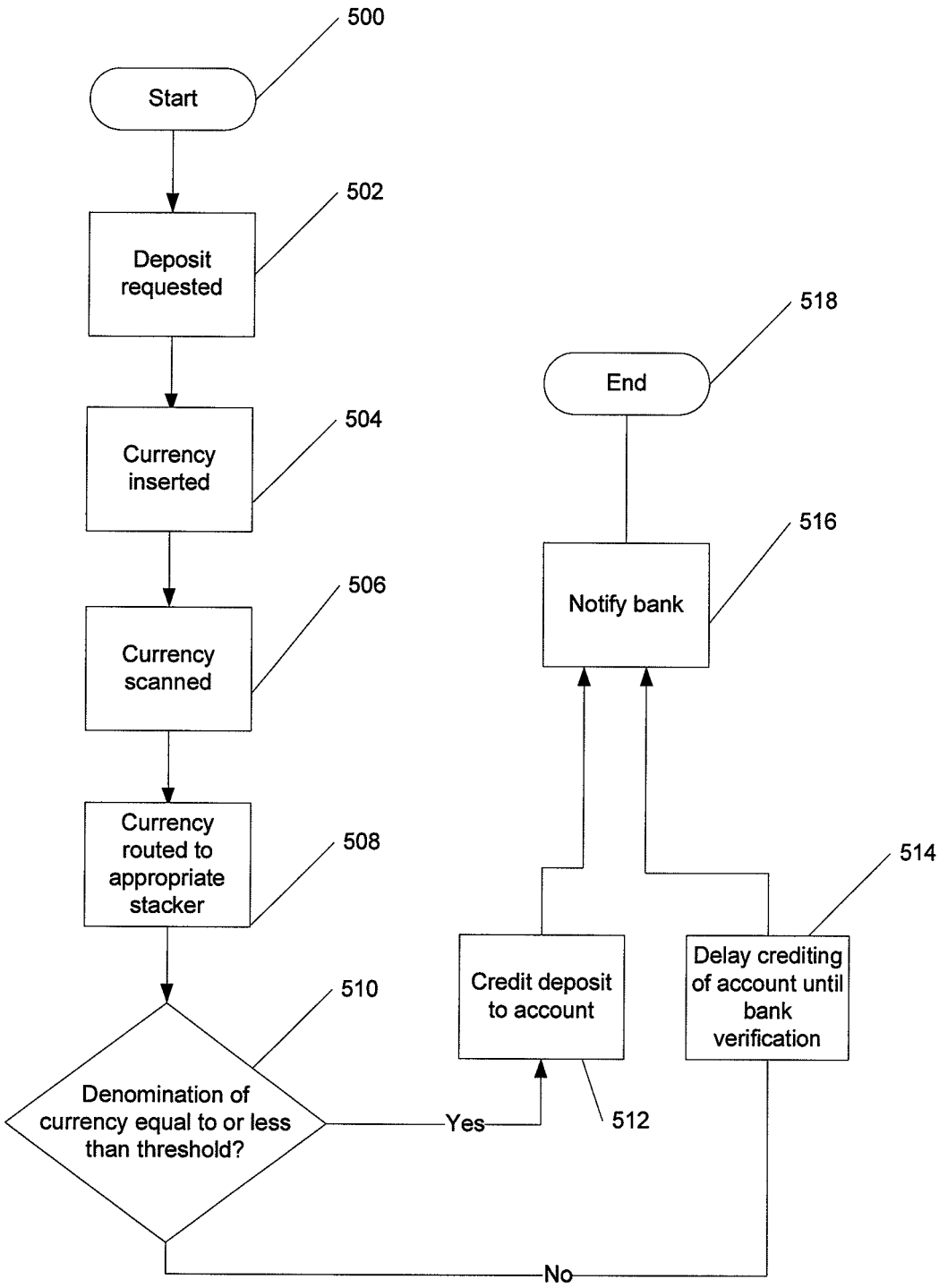
FIG. 5 illustrates an example of method to provide flexible demarcation points in order to selectably recognize currency deposited into a cash handling device.

FIG. 5 illustrates an example of method to provide flexible demarcation points in order to selectably recognize currency deposited into a cash handling device. Upon start 500, a user may use an input means on the cash handling device in order to request a deposit 502. The user may then insert currency into the cash handling device 504.

The currency may then be scanned 506. The scanning of the currency may perform a variety of functions. For example, scanning of the currency may enable an automatic determination of the denomination of the currency. Also, the scanning may help to detect invalid reproductions of currency money or other improper deposit attempts.

After scanning 506, the currency may then be routed to the appropriate stacker 508. The cash handling device 200 may have multiple stackers 217A-217F. Each stacker 217A-217F may correspond to a specific currency denomination. More than one stacker may correspond to the same denomination.

A determination may be made as to whether the currency is equal to, less than, and/or greater than a threshold 510. This denomination threshold may provide a flexible demarcation point between what deposits (or portions thereof) are credited and recognized at one time and what deposits (or portions thereof) are credited and recognized at another time. Whether deposits are immediate recognized or recognized at a later time may depend on a level of trust a financial institution has with the customer making the deposit, the denominations deposited, the amount of the deposit and the like.

For example, if the denomination of currency that is deposited is less than or equal to a denomination threshold 510, then the deposit may be credited automatically or promptly to an account 512. Alternatively, if the denomination of currency that is deposited is greater than a denomination threshold 510, then crediting and recognition of the deposit to an account may be delayed until after bank verification 514. In some arrangements, however, provisional credit may be provided for the deposit until bank verification.

In either event 512, 514, the cash handling device optionally may provide a notification to the bank with information about the deposit or the deposited currency.

Figure 6:
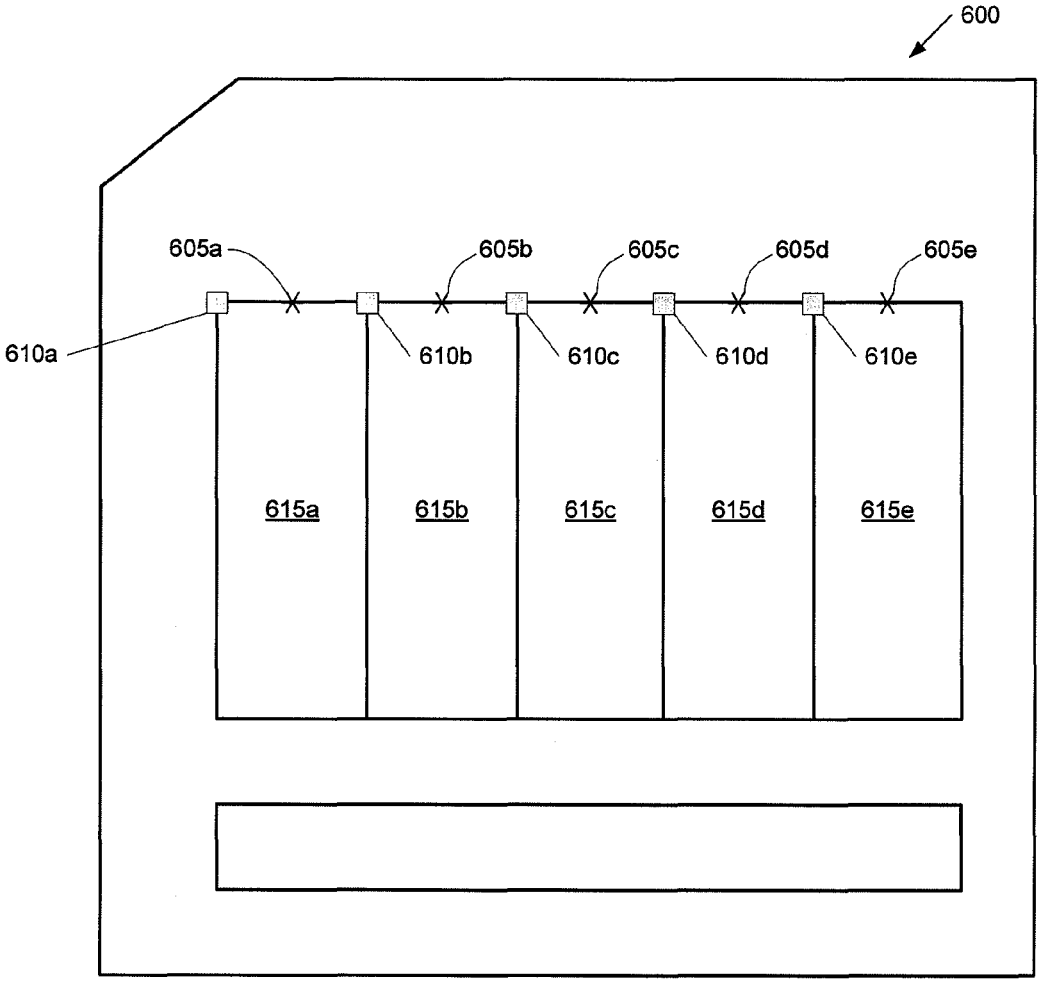
FIG. 6 illustrates a cash handling device having configurable recognition and access demarcation points according to one or more aspects described herein.

Alternatively or additionally, recognition of funds may be based on a physical demarcation within a cash handling device. FIG. 6 illustrates a cash handling device 600 having multiple possible recognition demarcation points 605. Recognition demarcation points 605 refer to physical points in cash handling device 600 where deposited currency, once past one of points 605, is recognized by a financial institution. As illustrated, demarcation points 605 may be located above each stacker 615 and configured with sensors 610 that may be individually configurable. In particular, sensors 610 may be turned on or off based on whether currency is to be recognized once past that particular sensor and demarcation point. Thus, in one example, if $20 bills and $50 bills are not to be recognized until, e.g., verification by the financial institution, sensors 610*d* and 610*e* may be turned off or a processor or controller to which signals from sensors 610*d* and 610*e* are sent for processing may be configured to not submit the detected currency to the financial institution for recognition. Alternatively, the decision regarding whether to recognize the funds or not may be made by the financial institution based on demarcation point configuration data that may be sent as part of a real-time recognition request. Instead of recognizing the funds, the financial institution may provide provisional credit.

In one or more arrangements, if currency has not yet been recognized, a customer may be authorized to handle that currency. On the other hand, if currency has already been recognized, the customer may be prohibited from handling the currency. Specifically, demarcation points may also define what currency may be handled once it has entered the cash handling device. In one example, a demarcation point may be configured so that $1 and $5 bills are not recognized so that a customer is allowed to handle those denominations even once it has entered the cash recycler and/or stacker. Since $1 and $5 bills are of lower value, a financial institution might not consider the risk of theft to be as high. This may allow the customer to clear their own jams for $1 and $5 denominations (e.g., jams occurring within stackers 615*a* and 615*b*) and potentially save on service costs to have an authorized repair technician clear the jam. Since the $10 and up denominations are more valuable, a financial institution may choose not to allow handling of those denominations and thus, currency that has passed demarcation points 610*c*, 610*d* and 610*e* into stackers 615*c*, 615*d* and 615*e*, respectively, may be restricted from access. Restricting stackers 615*c*, 615*d* and 615*e* from access may be affected in a variety of ways including the use of individually configurable locks as described in "SELECTABLE ACCESS TO COMPARTMENTS IN A CASH HANDLING DEVICE", assigned U.S. patent Ser. No. 12/183,910, and filed Jul. 31, 2008) filed concurrently herewith.

In one or more arrangements, various recognition and handling rules may be defined. For example, whether access is permitted might not be tied to recognition. Thus, access may be permitted even for recognized currency for one or more demarcation points while access and recognition may both be denied for another demarcation point. Such recognition and handling rules may be defined based on a level of trust the financial institution has with a given customer or other factors. Additionally, demarcation points may be configured based on time such that one set of demarcation rules are used during a first period of time and a second set of demarcation rules are used during a second period of time. For example, a cash handling device at a retail store may configure one or more demarcation points such that recognition and access may be provided for one or more stackers during regular business hours due to, e.g., a smaller chance of theft. After business hours, however, recognition might still be granted, but access may be restricted for the one or more stackers. A demarcation point may further be configured for an area of a cash handling device, rather than for a specific stacker or roller. That is, a demarcation point may specify the recognition and access rules for multiple stackers or rollers in a particular area of the cash handling device.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

We claim:

1. A method comprising:

receiving currency inserted into a cash recycler, said currency having a denomination and received for deposit only in a single account serviced by a remote cash recycler service associated with a bank;

determining whether the denomination of the currency is less than or equal to a denomination threshold, the denomination threshold being a currency value less than a maximum currency value accepted by the cash recycler;

crediting the deposited currency to the account if the denomination of the currency is less than or equal to the denomination threshold, wherein the crediting to the account includes providing real-time recognition, by the bank, of the deposited currency in the account at the time the currency received into the cash recycler is determined to be less than or equal to the denomination threshold;

delaying crediting of the currency to the account until bank verification if the denomination of the currency is greater than the denomination threshold;

providing provisional credit of the currency to the account when the denomination of the currency is greater than the denomination threshold; and upon occurrence of the bank verification, crediting the currency having a denomination greater than the denomination threshold to the account.

2. The method of claim 1 further comprising:

routing the currency to a stacker corresponding to the denomination.

3. The method of claim 1 further comprising:

scanning the currency in order to determine its said denomination.

4. The method of claim 1 further comprising:

notifying a bank of the deposited currency; and responsive to the notifying, crediting the deposited currency to said account by the bank when the deposited currency was not previously credited.

5. The method of claim 1 further comprising:

notifying a bank that said currency has been deposited and that verification is required.

6. The method of claim 1 further comprising:

setting the denomination threshold locally.

7. The method of claim 1 further comprising:

setting the denomination threshold remotely.

8. A non-transitory tangible computer-readable medium storing computer-executable instructions that cause a processor to:

receive currency inserted into a cash handling device, said currency having a denomination;

determine whether the denomination of the currency is less than or equal to a denomination threshold, the denomination threshold being a currency value less than a maximum currency value accepted by the cash handling device;

credit the deposited currency to an account if the denomination of the currency is less than or equal to the denomination threshold, wherein the crediting to the account includes providing real-time recognition of the deposited currency in the account; and delay crediting of the account if the denomination of the currency is greater than the denomination threshold.

9. A method comprising:

setting a denomination threshold, the denomination threshold being a currency value less than a maximum currency value;

receiving a request for a deposit;

receiving currency inserted into a cash handling device, said currency having a denomination;

scanning the currency in order to determine its said denomination;

routing the currency to a stacker corresponding to the denomination;

determining whether the denomination of the currency is less than or equal to the denomination threshold;

crediting the deposited currency to an account if the denomination of the currency is less than or equal to the denomination threshold, wherein the crediting to the account includes providing real-time recognition of the deposited currency in the account;

delaying crediting of the account if the denomination of the currency is greater than the denomination threshold; and communicating information about the deposited currency to a bank.

10. The method of claim 9 wherein the denomination threshold is selected from the group consisting of: $5, $10, $20, $50, $100, €5, €10, €20, €50, and €100.

11. The method of claim 9 further comprising:

setting the denomination threshold remotely.

12. A non-transitory tangible computer-readable medium storing computer-executable instructions that cause a processor to:

set a denomination threshold, the denomination threshold being a currency value less than a maximum currency value;

receive a request for a deposit;

receive currency inserted into a cash handling device, said currency having a denomination;

scan the currency in order to determine its said denomination;

route the currency to a stacker corresponding to the denomination;

determine whether the denomination of the currency is less than or equal to the denomination threshold;

credit the deposited currency to an account if the denomination of the currency is less than or equal to the denomination threshold, wherein the crediting to the account includes providing real-time recognition of the deposited currency in the account;

delay crediting of the account if the denomination of the currency is greater than the denomination threshold; and communicate information about the deposited currency to a bank.

13. An apparatus comprising:

a processor for executing computer-executable instructions;

memory that stores the computer-executable instructions;

at least three stackers for storing currency, each said stacker holding different currency denominations;

an input means for receiving user input to request a deposit;

a scanner to scan said currency in order to determine its said currency denomination; and a display for displaying messages in accordance with the computer-executable instructions;

wherein the computer-executable instructions cause the apparatus to:

receive said currency inserted into the apparatus after the input means receives said user input requesting said deposit;

scan the currency in order to determine its said denomination;

route the currency to one of said at least three stackers corresponding to the denomination;

determine whether the denomination of the currency is less than or equal to a denomination threshold, the denomination threshold being a currency value less than a maximum currency value;

credit the deposited currency to an account if the denomination of the currency is less than or equal to the denomination threshold, wherein the crediting to the account includes providing real-time recognition of the deposited currency in the account; and delay credit of the account if the denomination of the currency is greater than the denomination threshold.

14. The apparatus of claim 13 wherein the denomination threshold is selected from the group consisting of: $5, $10, $20, $50, $100, €5, €10, €20, €50, and €100.

15. The apparatus of claim 14 further comprising a communication interface and the computer-executable instructions also cause the apparatus to communicate information about the deposited currency through the communication interface to a bank.

16. The apparatus of claim 13 further comprising:

a communication interface through which the denomination threshold is set remotely.

17. The apparatus of claim 16 wherein the apparatus comprises a cash recycler.

18. The apparatus of claim 13 wherein the apparatus comprises a cash recycler.

* * * * *